US011754283B1

(12) United States Patent
Bacon

(10) Patent No.: US 11,754,283 B1
(45) Date of Patent: Sep. 12, 2023

(54) FLARE GAS SYSTEM

(71) Applicant: David Bacon, Bastrop, TX (US)

(72) Inventor: David Bacon, Bastrop, TX (US)

( * ) Notice: Subject to any disclaimer, the term of this patent is extended or adjusted under 35 U.S.C. 154(b) by 393 days.

(21) Appl. No.: 17/227,673

(22) Filed: Apr. 12, 2021

Related U.S. Application Data

(63) Continuation-in-part of application No. 17/167,541, filed on Feb. 4, 2021, and a continuation-in-part of application No. 16/108,534, filed on Aug. 22, 2018, now Pat. No. 10,989,407, which is a continuation-in-part of application No. 15/587,960, filed on May 5, 2017, now Pat. No. 10,584,873.

(60) Provisional application No. 62/403,301, filed on Oct. 3, 2016, provisional application No. 62/332,811, filed on May 6, 2016.

(51) Int. Cl.

| | |
|---|---|
| ***F23C 7/00*** | (2006.01) |
| ***F23G 7/08*** | (2006.01) |
| ***F23L 5/02*** | (2006.01) |
| ***F23D 23/00*** | (2006.01) |
| ***F23D 14/58*** | (2006.01) |

(52) U.S. Cl.
CPC ..... *F23G 7/085* (2013.01); *F23D 14/58* (2013.01); *F23D 23/00* (2013.01); *F23L 5/02* (2013.01); *F23D 2203/007* (2013.01); *F23G 2209/141* (2013.01)

(58) Field of Classification Search
CPC .... F23G 7/085; F23G 2209/141; F23D 14/58; F23D 23/00; F23D 2203/007; F23L 5/02
USPC ..... 431/5, 202
See application file for complete search history.

(56) References Cited

U.S. PATENT DOCUMENTS

| | | | |
|---|---|---|---|
| 4,824,361 | A | 4/1989 | McGill et al. |
| 5,810,575 | A | 9/1998 | Schwartz et al. |
| 6,146,131 | A | 11/2000 | Wiseman |
| 2006/0121399 | A1 | 6/2006 | Mashhour et al. |
| 2010/0291492 | A1 | 11/2010 | Poe et al. |
| 2015/0050603 | A1 | 2/2015 | Griffin et al. |

*Primary Examiner* — Avinash A Savani
(74) *Attorney, Agent, or Firm* — 1 Bushman Werner, P.C.

(57) ABSTRACT

The flare gas system has a flare gas assembly having an air pipe with an open upper end, a first conduit in surrounding relationship to the air pipe and having a first conduit open upper end, a second conduit in surrounding relationship to the first conduit and having a second conduit upper end, and a third conduit in surrounding relationship to the second conduit and having a third conduit upper end, the upper ends of the air pipe, the first conduit and the second conduit being below the upper end of the third conduit, there being an air source connected to the air pipe to provide air to the air pipe at a desired flow rate. There is at least one second flare gas assembly operatively connected to the first flare gas assembly, the second flare gas assembly having a tubular housing in which is mounted a spring biased orifice plate, the tubular housing being in open communication with the annulus formed below the second and third conduits.

14 Claims, 6 Drawing Sheets

FLARE GAS SYSTEM

CROSS REFERENCE TO RELATED APPLICATION

This application is a continuation-in-part of U.S. application Ser. No. 16/108,534 filed on Aug. 22, 2018, which in turn is a continuation-in-part of U.S. Ser. No. 15/587,960 filed May 5, 2017, which in turn claims the benefit of provisional U.S. Ser. No. 62/403,301 filed Oct. 3, 2016, and provisional 62/332,811 filed May 6, 20216; and this application is a continuation-in-part of U.S. application Ser. No. 17/167,541 filed on Feb. 4, 2021, all the disclosures above being incorporated herein by reference for all purposes.

FIELD OF THE INVENTION

The present invention relates to flares for burning waste gas and, more particularly, to a flare gas system for burning a plurality of flare gases, e.g., high pressure and low pressure flare gases.

BACKGROUND OF THE INVENTION

At oil and gas well sites, particularly where drilling is conducted in shale formations, there is an array of equipment, as for example tank batteries to collect crude oil and/or distillates from the oil and gas wells, as well as separators to separate gas/water from hydrocarbons. Generally speaking, tank batteries are a source of low pressure flare gas while separators are a source of high pressure flare gas. Low pressure flare gases typically have a pressure less than about 50 psig while high pressure flare gas can have a pressure of from 50 to 1500 psig In either event, the gases cannot be allowed to accumulate as the pressure build up could create hazards to humans as well as potential damage to equipment. Nor can they be vented to atmosphere for environmental reasons. To alleviate this problem, these gases, both high and low pressure, are vented from the equipment and flared using a suitable flare gas assembly.

SUMMARY OF THE INVENTION

In one aspect, the present invention relates to a flare gas system for burning a plurality of flare gases.

In yet another aspect, the present invention relates to a flare gas system which can flare a plurality of flare gases, wherein one of the gases may be low pressure gas.

In a further aspect, the present invention relates to a method of flaring of a plurality of flare gases.

These and further features and advantages of the present invention will become apparent from the following detailed description, wherein reference is made to the figures in the accompanying drawings.

DETAILED DESCRIPTION OF PREFERRED EMBODIMENTS

Figure 1:
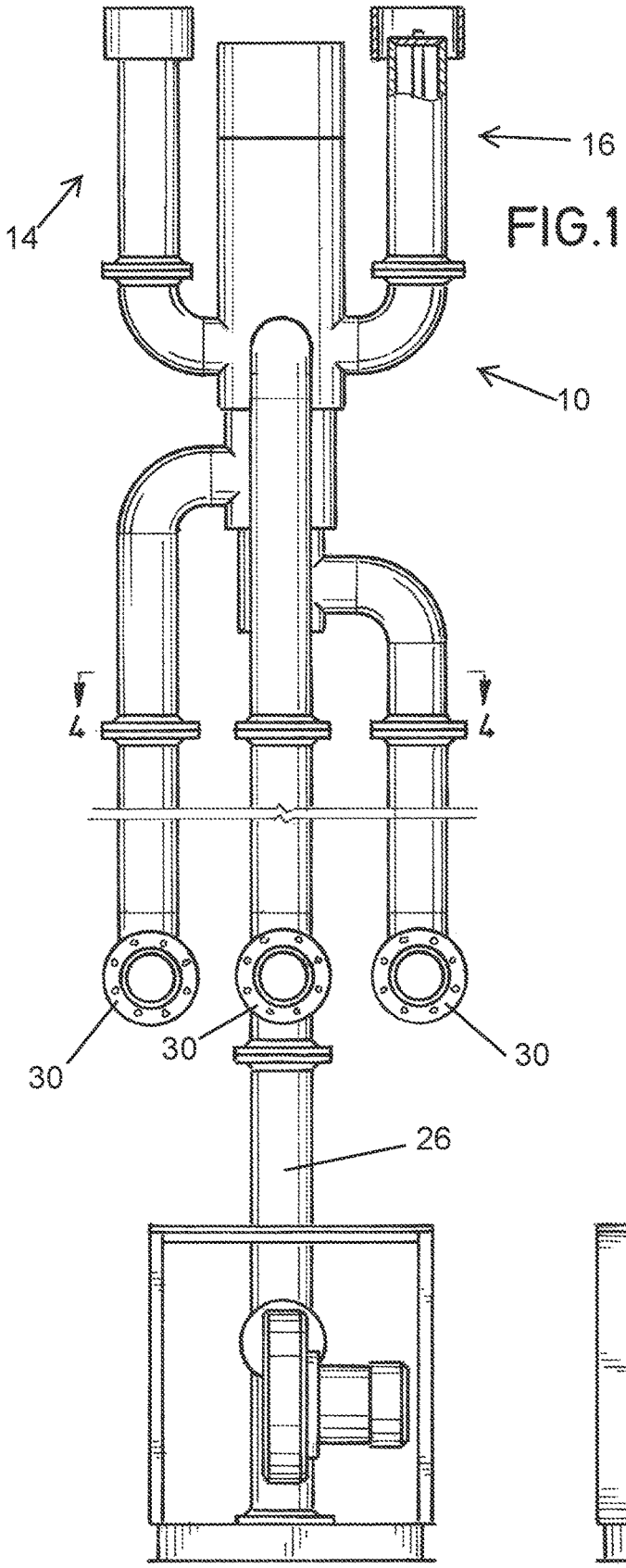
FIG. 1 is a perspective, elevational view of one embodiment of the flare gas system of the present invention.
Figure 2:
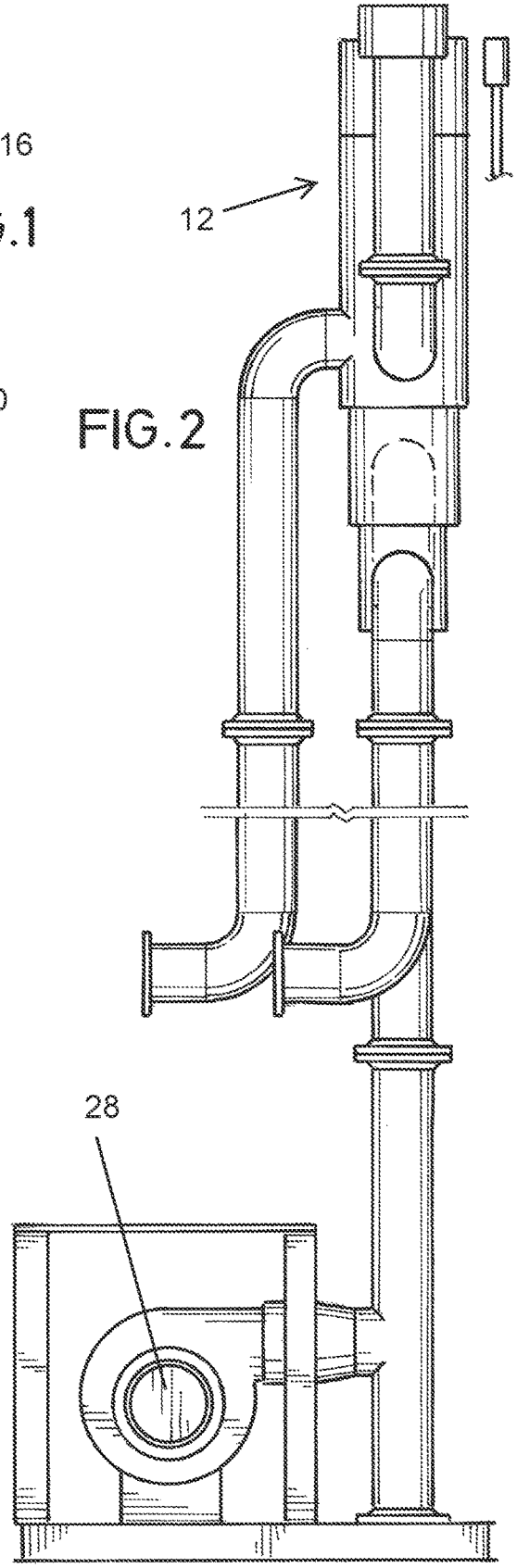
FIG. 2 shows the flare gas system of FIG. 1 rotated 90°.
Figure 3:
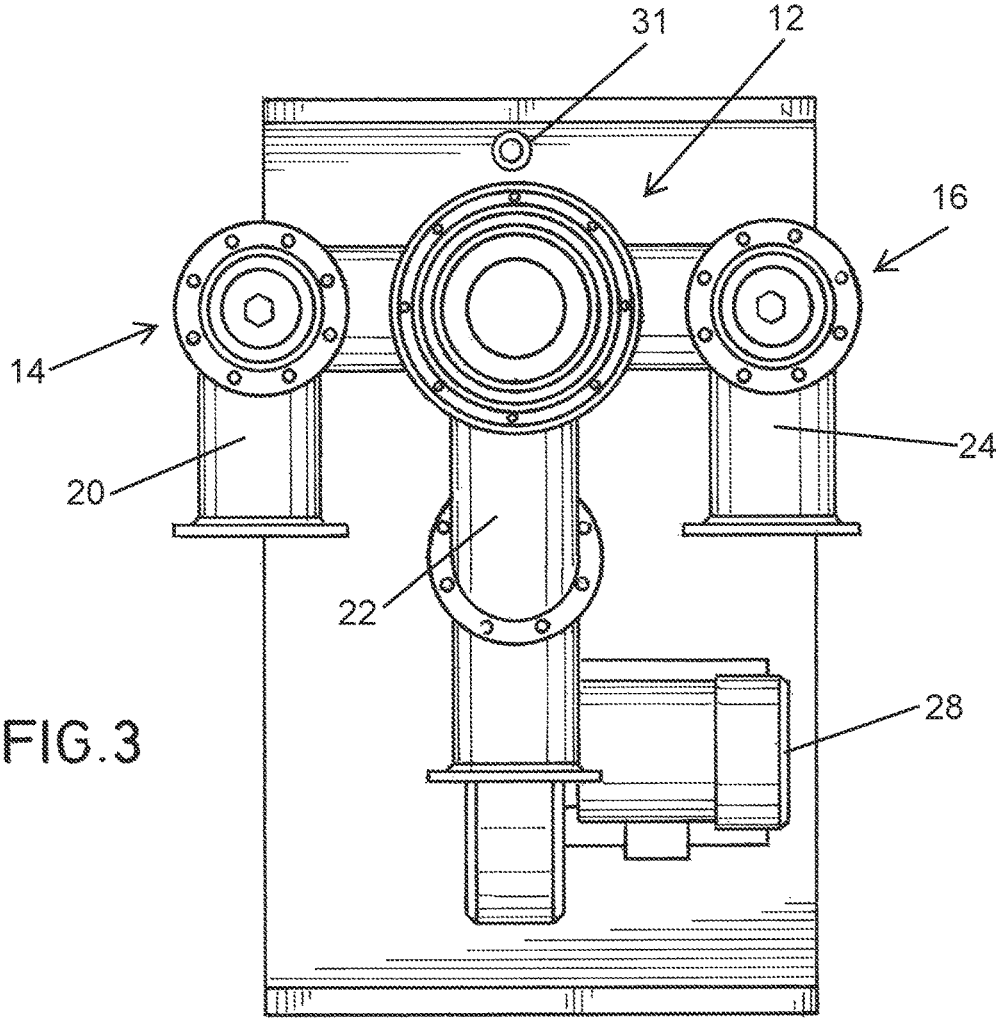
FIG. 3 is a top, plan view of the flare gas system shown in FIG. 1.
Figure 4:
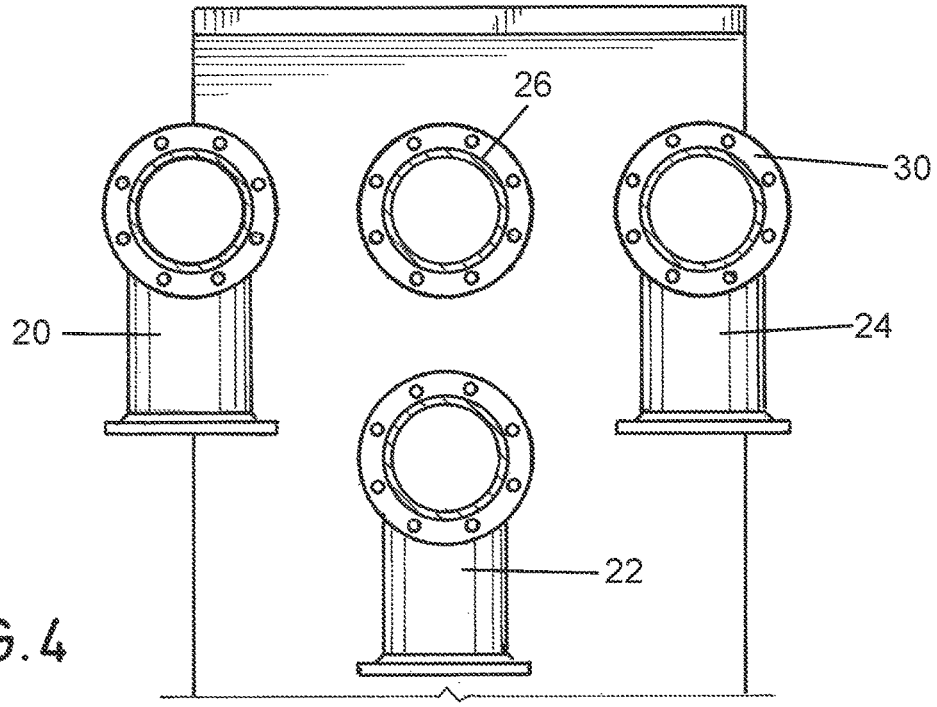
FIG. 4 is a cross-sectional view taken along the lines 4-4 of FIG. 1.

The flare gas system of the present invention is designed to accommodate the flaring of a plurality of flare gases which can include high pressure and low pressure flare gases. To this end, the flare gas system of the present invention has at least one flare gas assembly which can accommodate both high and low pressure gases and at least two flare gas assemblies for high pressure flare gases. While the system will be described with respect to the use of two high pressure flare gas assemblies, it will be understood that three or more such flare gas assemblies can be employed if necessary. In any event, the flare gas assemblies are married together to form at least one embodiment of the present invention.

Turning first to FIGS. 1-4, there is shown a flare gas system 10 in accordance with one embodiment of the present invention wherein there is a first flare gas assembly shown generally as 12 and used primarily for lower pressure flare gas, and two flare gas assemblies shown generally as 14 and 16 for use with high pressure flare gas. The system 10 includes a first flare gas feed line 20, a second flare gas feed line 22, and a third flare gas feed line 24. There is an air line 26 which feeds combustion air to the flare gas assembly, combustion air being supplied by blower 28 which can be of a type disclosed in U.S. Pat. No. 10,584,873 (C873 Patent), the disclosure of which is incorporated herein by reference for all purposes. There is an igniter 31 positioned near married flare gas assemblies to ignite the flare gas assemblies.

As can be seen from the drawings, the system can be fabricated, in part, from various sizes of pipe and conduit, the needed connections being made by way of bolt flanges shown as 30 in FIG. 1.

Figure 5:
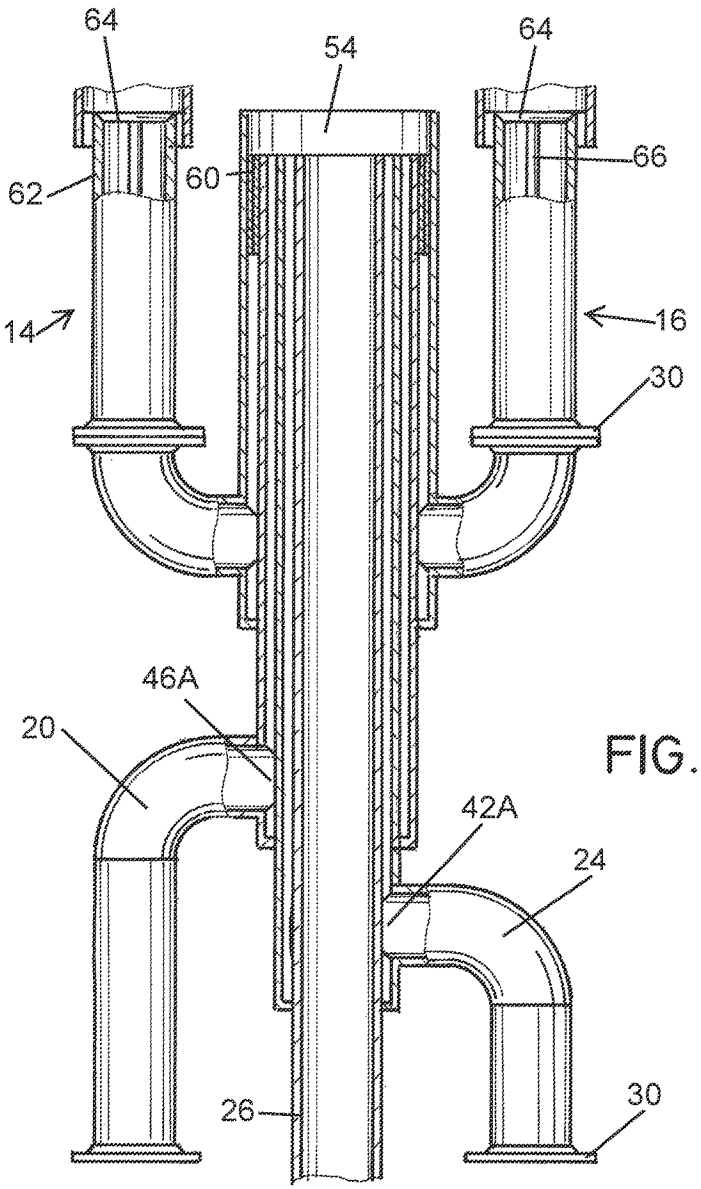
FIG. 5 is an elevational view, partly in section, showing in greater detail the flare gas system of FIG. 1.
Figure 6:
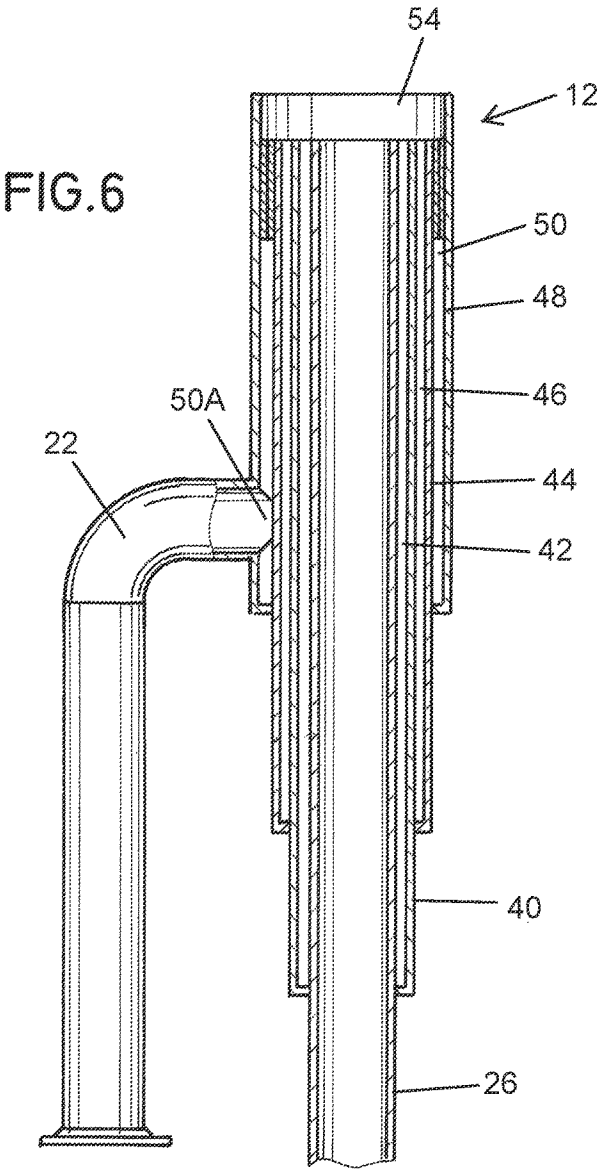
FIG. 6 shows the flare gas system of FIG. 5 rotated 90°.
Figure 7:
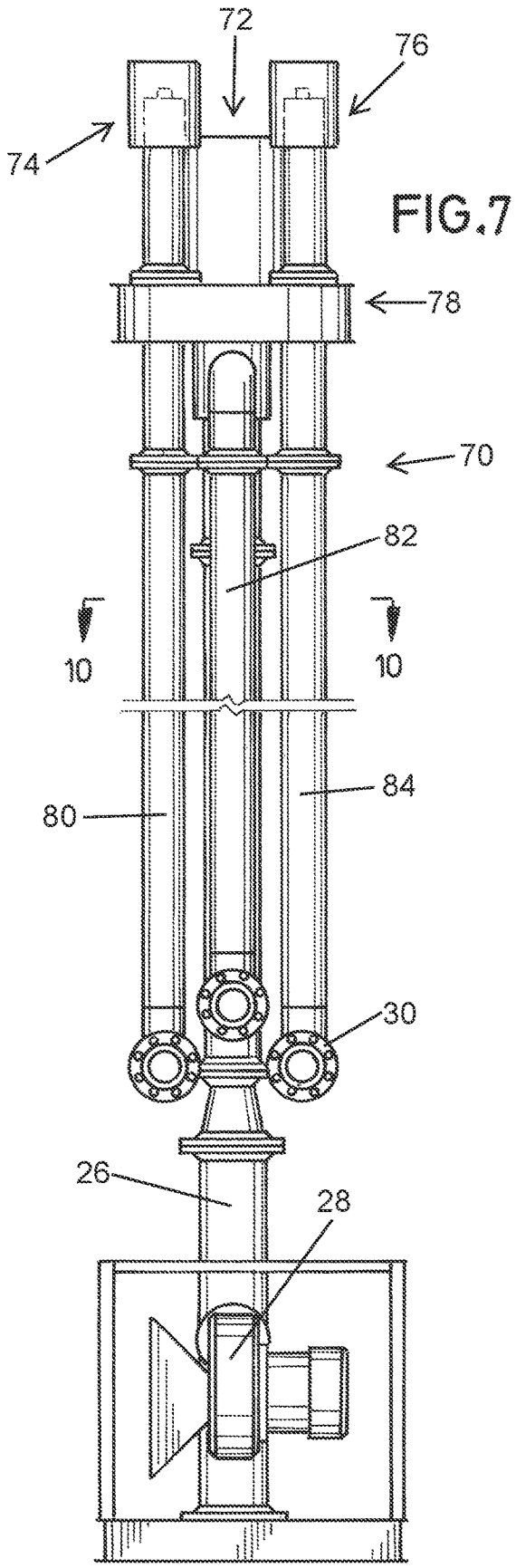
FIG. 7 is a perspective, elevational view of another embodiment of the flare gas system of the present invention.
Figure 8:
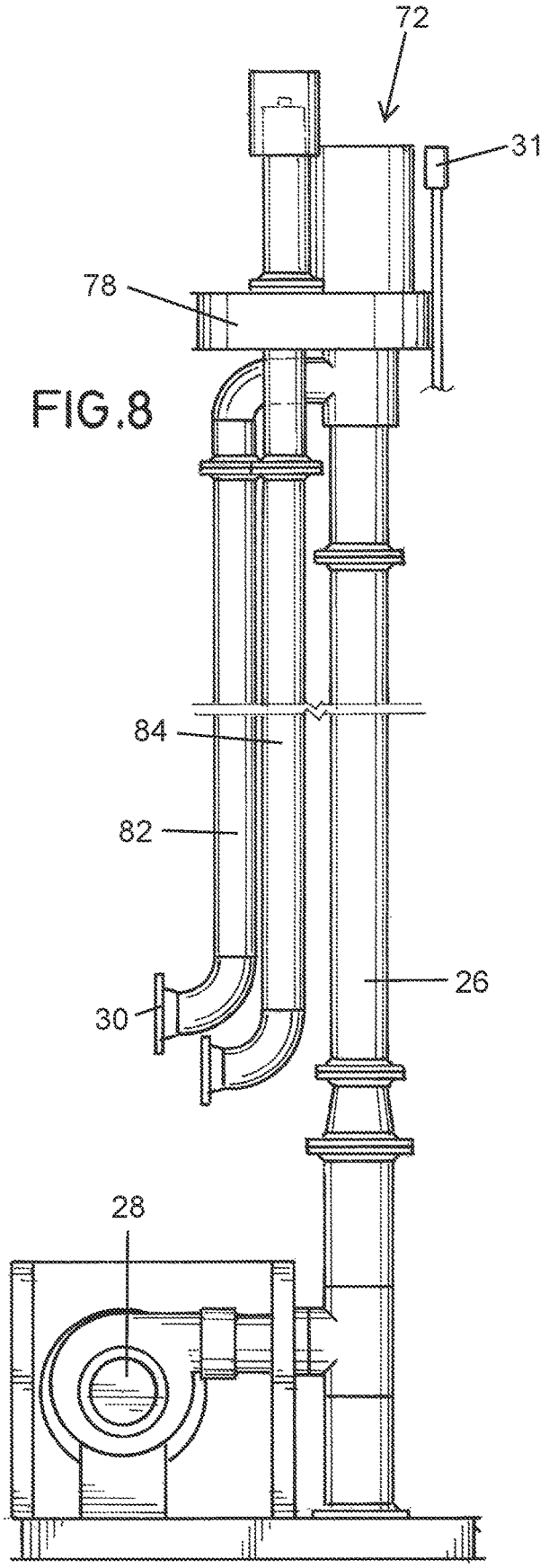
FIG. 8 shows the flare gas system of FIG. 7 rotated 90°.
Figure 9:
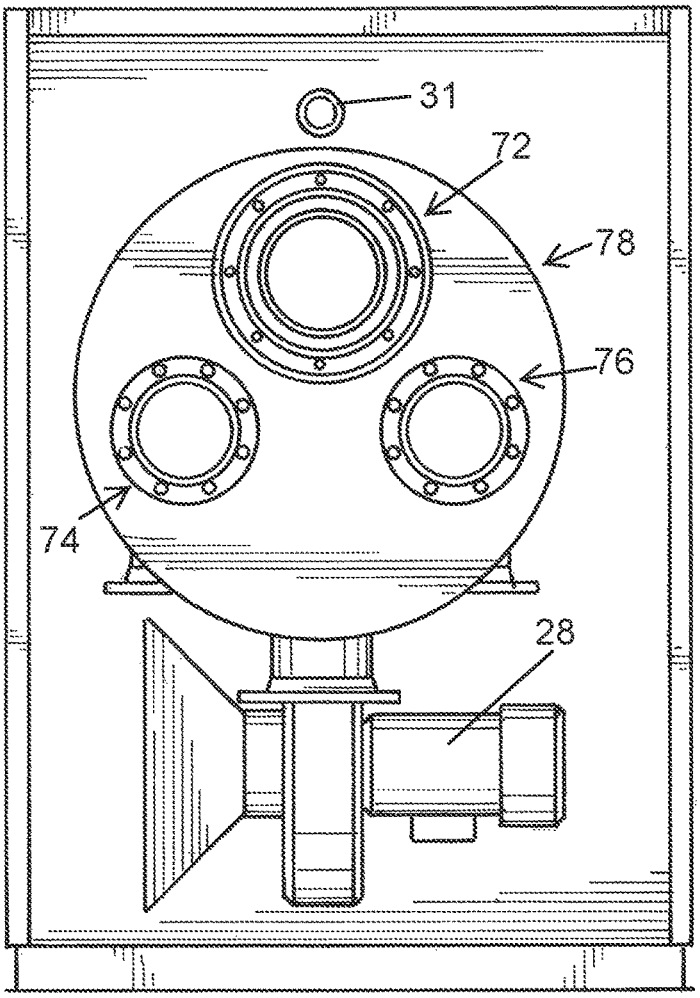
FIG. 9 is a top, plan view of the flare gas system shown in FIG. 7.
Figure 10:
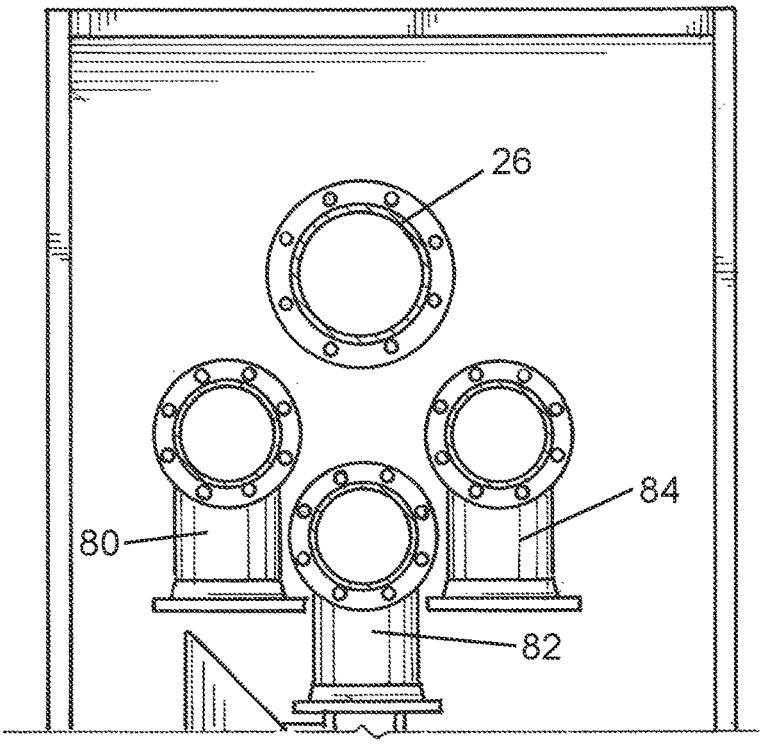
FIG. 10 is a cross-sectional view taken along the lines 10-10 of FIG. 7.

Turning now to FIGS. 5 and 6, flare gas assembly 12 is seen to comprise a first tubular conduit 40 in surrounding relationship to air pipe 26, a first annulus 42 being formed therebetween. A second tubular conduit 44 is in surrounding relationship to first conduit 40, a second annulus 46 being formed therebetween. There is a third tubular conduit 48 in surrounding relationship to second conduit 44, a third annulus 50 being formed therebetween. As can be seen, air pipe 26, conduit 40, conduit 44, and conduit 46 have open, upper ends which are all below the open upper end of tubular conduit 48. Generally speaking, the open upper ends of air pipe 26, conduit 40, and conduit 44 are each from about 2 to about 8 inches below the open upper end of conduit 48. In a preferred case, the open upper ends of air pipe 26, conduit 40, and conduit 44 are coterminous. A mixing chamber 54 is formed above the open upper ends of air pipe 26, conduit 40, and conduit 44, the mixing chamber being formed in part by a peripheral wall section of conduit 48.

As can be seen from FIGS. 5 and 6, gas feed line 22 is in open communication with annulus 50 via gas inlet 50A, gas feed line 20 is in open communication with annulus 46 via gas inlet 46A, and gas feed line 24 is in open communication with annulus 42 via gas inlet 42A.

Disposed in annulus 50 is a flow restrictor 60, flow restrictor 60 comprising an annular plate through which extend a plurality of orifices, the orifices being aligned axially with annulus 50. While as shown restrictor 60 has substantial height relative to wall thickness, in point of fact, the height or thickness of flow restrictor 60 can be as little as ¼" and thus can be easily fabricated by drilling holes through an annular plate. It is to be noted that the orifices in restrictor 60, while shown as axially aligned with annulus 50, could be angled so as to impart a swirling motion in chamber 54.

Flare gas assemblies 14 and 16 are fully described in U.S. patent application Ser. No. 17/167,541, the disclosure of which is incorporated herein by reference for all purposes. Suffice it to say that flare gas assemblies 14 and 16 comprise a tubular housing 62 in which is reciprocally mounted a spring biased valve element 64, valve element 64 being mounted on a shaft 66.

In operation, and generally speaking, high pressure flare gas would be introduced into annulus 50 via flare gas feed line 22. Low pressure flare gas would be typically introduced into annulus 42 via flare gas feed line 24, and a third flare gas would be introduced into annulus 46 via flare gas feed line 20. It will be understood however that the flare gases introduced into the various annuli could all be high pressure, low pressure, or intermediate pressure. However, in a preferred case, high pressure flare gas is introduced into annulus 50 so that it passes through flow restrictor 60 and imparts momentum to the air/flare gas mixture in chamber 54. Additionally, typically a low pressure gas would be introduced into annulus 42 so as to be mixed in chamber 54 by combustion air issuing from air conduit 26. Further, high pressure gas in annulus 50 also flows into pressure operated variable orifice flare gas assemblies 14 and 16.

Turning now to FIGS. 7-10, there is shown another embodiment of the flare gas system of the present invention. The system shown in FIGS. 7 and 8 differs from that shown in FIGS. 1 and 2 primarily in the fact that in the flare gas system of FIGS. 7 and 8, a flare gas handler is employed. There is a first flare gas assembly 72, a second flare gas assembly 74, and a third flare gas assembly 76. Flare gas assemblies 74 and 76 are substantially the same as flare gas assemblies 14 and 16 described above. Gas handler 78, described more fully below, is connected to flare gas assemblies 72, 74, and 76. There is a first flare gas feed line 80, a second flare gas feed line 82, and a third flare gas feed line 84.

Figure 12:
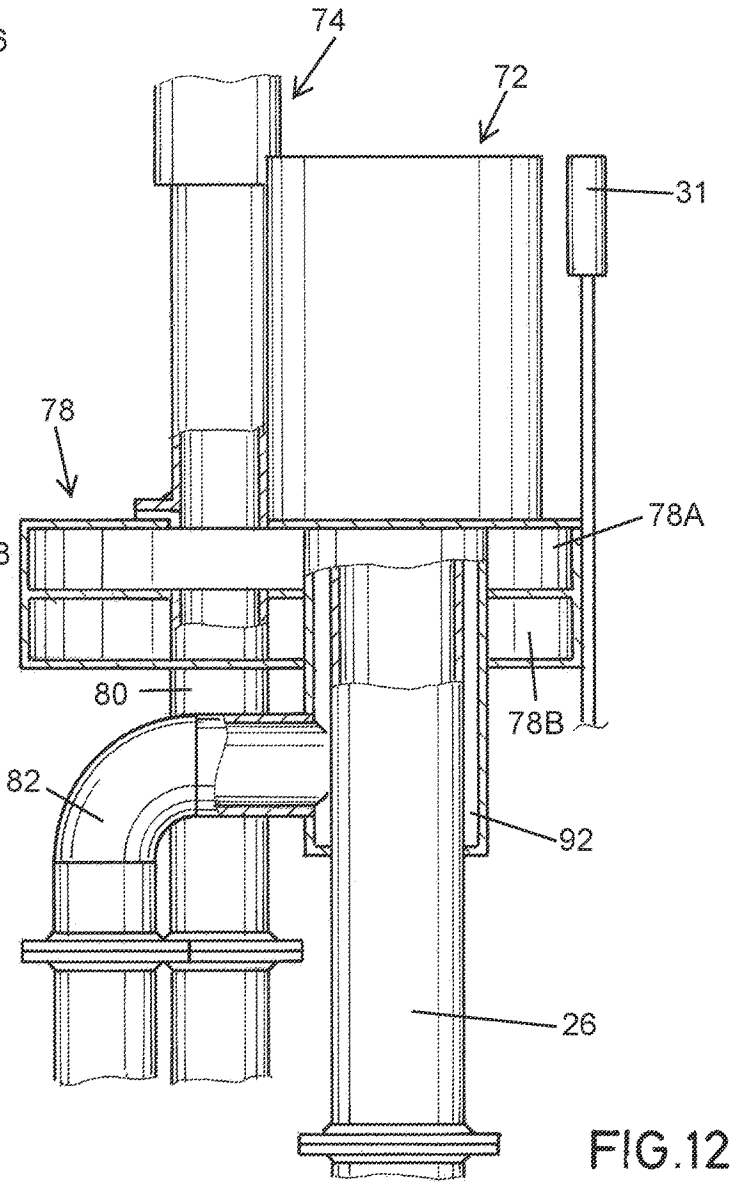
FIG. 12 shows the flare gas system of FIG. 11 rotated 90°.
Figure 11:
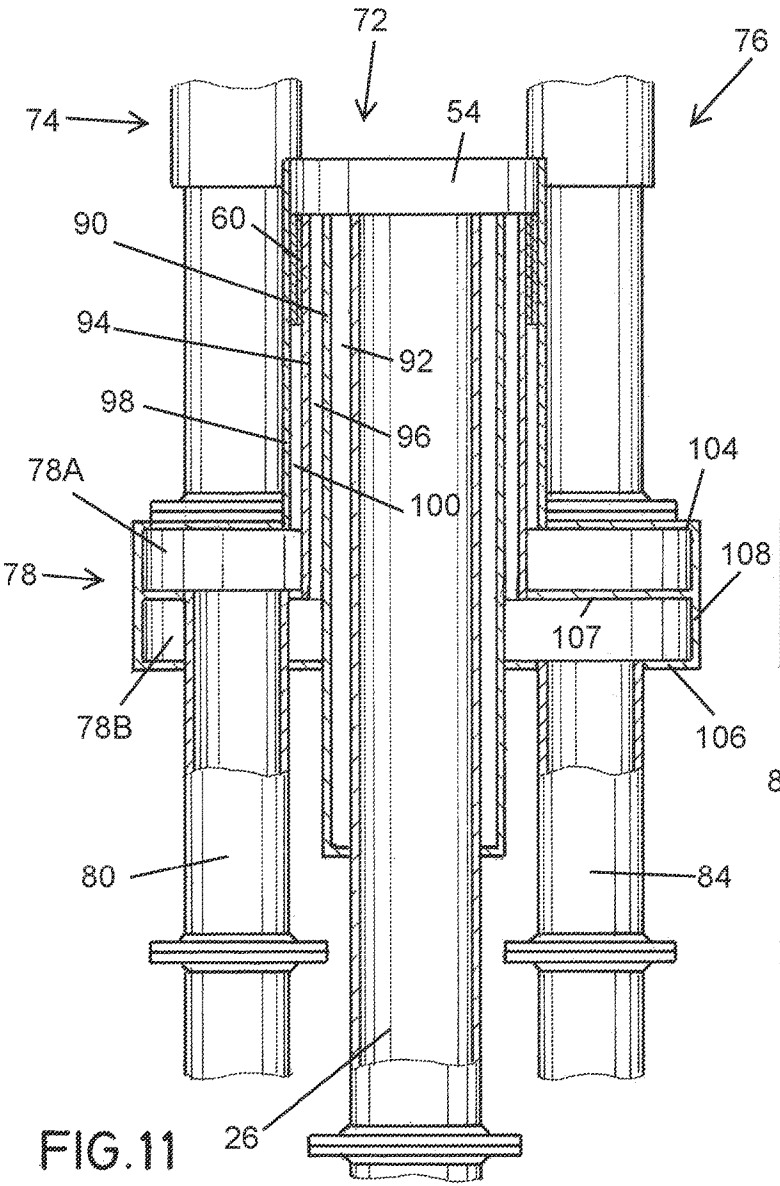
FIG. 11 is an elevational view, partly in section showing in greater detail the flare gas system of FIG. 7.

Turning now to FIGS. 11 and 12, it can be seen that flare gas assembly 72 comprises air pipe 26, there being a first conduit 90 in surrounding relationship to air pipe 26, a first annulus 92 being formed therebetween. There is a second conduit 94 in surrounding relationship to conduit 90, a second annulus 96 being formed therebetween. There is also a third conduit 98 in surrounding relationship to second conduit 94, there being a third annulus 100 being formed therebetween. Basically, the construction of flare gas assembly 72 is substantially the same as flare gas assembly 12 described above.

Gas handler 78 forms a first plenum 78A and a second plenum 78B. Gas handler 78 basically comprises an upper wall 104, a lower wall 106, an intermediate wall 107, and a peripheral wall 108. As can be seen, flare gas feed line 80 is in open communication with first plenum 78A, while flare gas feed line 84 is in open communication with second plenum 78B. Plenum 78A is in open communication with annulus 100 in which is disposed a flow restrictor 60 described above with respect to the embodiments of FIGS. 1 and 2. Plenum 78B is in open communication with annulus 96. Gas feed line 82 is in open communication with annulus 92.

In a typical operation, high pressure flare gas is fed into plenum 78A where it would pass both into annulus 100 through flow restrictor 60 and into flare gas assemblies 74 and 76. Low pressure flare gas would typically be introduced into annulus 92 via flare gas feed line 82, and a third flare gas would be introduced via flare gas feed line 84 in plenum 78B into annulus 94. Thus, the high pressure flare gas would both flow through the restrictor 60 and into the pressure operated variable orifice flare gas assemblies comprising flare gas assemblies 74 and 76. The combined flare gases issuing from annuli 92, 96, and 100 are mixed with combustion air from air pipe 26 in chamber 54 and ignited by igniter 31.

One feature of the present invention is that a single igniter, e.g., igniter 31 can ignite the flare gases emanating from flare gas assembly 72 as well as flare gas assemblies 74 and 76. This is at least partially due to the novel arrangement of flow restrictor 60 which increases the velocity of the flare gas issuing from annulus 100 and effects cross-lighting of not only the lower pressure flare gas assembly 72 but flare gas assemblies 74 and 76 as well.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A flare gas system for flaring a plurality of flare gases comprising:

A) a first flare gas assembly, said first flare gas assembly comprising:
- an air pipe having an open upper end;
- a first conduit in surrounding relationship to said air pipe and having a first conduit open upper end, a first annulus being formed between said air pipe and said first conduit, there being a first flare gas inlet into said first annulus;
- a second conduit in surrounding relationship to said first conduit and having a second conduit open upper end, a second annulus being formed between said first conduit and said second conduit, there being a second flare gas inlet into said second annulus;
- a third conduit in surrounding relationship to said second conduit and having a third conduit open upper end, a third annulus being formed between said second conduit and said third conduit, there being a third flare gas inlet into said third annulus;
- a flow restrictor disposed in said third annulus;

B) a second flare gas assembly, said second flare gas assembly comprising:
- a tubular housing, said housing being in open communication with said third annulus;
- a pressure operated valve assembly mounted in said housing.

2. The flare gas system of claim 1, further comprising:

a flare gas handler forming first and second plenums, said tubular housing being in open communication with said first plenum, said third annulus being in open communication with said first plenum, and said second plenum being in open communication with said second annulus.

3. The flare gas system of claim 1, wherein the distance between the closest of said upper end of said air pipe, said first conduit open upper end or said second conduit open upper end, to said third conduit open upper end is from about 2 to about 8 inches.

4. The flare gas system of claim 1, wherein said air pipe open upper end, said first conduit open upper end, and said second conduit open upper end are coterminous.

5. The flare gas system of claim 4, wherein the distance between said air pipe open upper end and said first conduit open upper end is from about 2 to about 8 inches.

6. The flare gas system of claim 1, wherein said first flare gas inlet is connected to a source of a first flare gas.

7. The flare gas system of claim 1, wherein said second flare gas inlet is connected to a source of a second flare gas.

8. The flare gas system of claim 1, wherein said third flare gas inlet is connected to a source of a third flare gas.

9. The flare gas system of claim 1, wherein there are a plurality of said second flare gas assemblies and a single igniter to ignite gas from said first flare gas assembly and said plurality of second flare gas assemblies.

10. The flare gas system of claim 1, comprising a blower connected to said air pipe, said blower being operated at a constant speed to provide a constant flow rate of air to said air pipe.

11. A flare gas system for flaring a plurality of flare gases comprising:

A) a first flare gas assembly, said first flare gas assembly comprising:

an air pipe;

a first conduit in surrounding relationship to said air pipe, a first annulus being formed between said air pipe and said first conduit, there being a first flare gas inlet into said first annulus;

a second conduit in surrounding relationship to said first conduit, a second annulus being formed between said first conduit and said second conduit, there being a second flare gas inlet into said second annulus;

a third conduit in surrounding relationship to said second conduit, a third annulus being formed between said second conduit and said third conduit, there being a third flare gas inlet into said third annulus;

a flow restrictor disposed in said third annulus;

a flare gas handler forming first and second plenums;

B) a second flare gas assembly, said second flare gas assembly comprising:

a tubular housing;

a pressure operated valve assembly mounted in said housing, said tubular housing being in open communication with said first plenum.

12. A method of operating a flare gas system, wherein the system comprises:

A) a first flare gas assembly comprising:

an air pipe having an open upper end, a first conduit in surrounding relationship to said air pipe and having a first conduit upper end, a first annulus being formed between said air pipe and said first conduit, a second conduit with a second conduit upper end in surrounding relationship to said first conduit, a second annulus being formed between said first and second conduits, and a third conduit with a third conduit upper end in surrounding relationship to said second conduit, a third annulus being formed between said second and third conduits, there being a flow restrictor disposed in said third annulus;

B) a second flare gas assembly comprising:

a tubular housing, said housing being in open communication with said third annulus;

a pressure operated valve assembly mounted in said housing;

said method comprising:

introducing a first flare gas into said first annulus;

introducing a second flare gas into said second annulus;

introducing a third flare gas into said third annulus;

introducing combustion air into said air pipe at a constant flow rate;

mixing said combustion air with said first, second, and third flare gases; and combusting said mixed combustion air and flare gases.

13. The method of claim 12, wherein said open upper end of said air pipe, said first conduit upper end, and said second conduit upper end are coterminous and below said third conduit upper end.

14. The method of claim 13, wherein said flare gas system comprises at least one blower connected to said air pipe, said blower being operated at a constant speed to provide a constant flow rate of combustion air to said air pipe.

* * * * *